United States Patent [19]

Wood

[11] 4,448,452

[45] May 15, 1984

[54] BOTTLE CARRIER

[75] Inventor: Prentice J. Wood, Hapeville, Ga.

[73] Assignee: The Mead Corporation, Dayton, Ohio

[21] Appl. No.: 411,707

[22] Filed: Aug. 26, 1982

Related U.S. Application Data

[63] Continuation of Ser. No. 269,572, Jun. 2, 1981, abandoned, which is a continuation of Ser. No. 155,146, May 30, 1980, abandoned.

[51] Int. Cl.[3] ..... B65D 71/00

[52] U.S. Cl. ..... 294/87.2; 294/87.22; 206/161

[58] Field of Search ..... 294/87.2, 87.28; 206/140, 148, 151, 190, 193, 196, 427, 435, 161; 229/28 BC, 89, 52 BC

[56] References Cited

U.S. PATENT DOCUMENTS 3,156,358 11/1964 Randrup ..... 294/87.2

3,633,962 1/1972 Erickson ..... 294/87.2

*Primary Examiner*—James B. Marbert

*Attorney, Agent, or Firm*—Rodgers & Rodgers

[57] ABSTRACT

A bottle carrier of the so-called neck-through, top gripping type is formed of semi-rigid material and comprises a frame structure in which a plurality of collars are formed each collar having at least one pair of lift tabs which are upwardly inclined and which engage the flange of a bottle to impart an upward lifting force thereto together with at least one pair of stabilizing tabs integrally formed with the frame structure and which engage a bottle shoulder so as to impart a force to the bottle shoulder which has a lateral component as well as a downward component and by this means to grip the bottle at spaced points one above the other and thereby to enhance the stability of the carrier.

7 Claims, 5 Drawing Figures

BOTTLE CARRIER

This application is a continuation of application Ser. No. 269,572 filed June 2, 1981 which application was a continuation of application Ser. No. 155,146 filed May 30, 1980, both now abandoned.

TECHNICAL FIELD

This invention pertains to the packaging of primary packages such as bottles having flanged neck portions and is arranged to envelop the bottle necks and to apply gripping forces thereto.

BACKGROUND ART

U.S. Pat. No. 3,493,261 which is owned by the assignee of this invention and U.S. Pat. No. 3,674,137 disclose article carriers of the wrap-around type in which apertures are formed in the top panel of the wrapper for receiving the necks of packaged bottles. Bottle engaging tabs are formed about the peripheries of the bottles and constitute positioning and gripping means for the bottles. Carriers of this type ordinarily are formed of paperboard material.

U.S. Pat. No. 3,633,962 discloses an article carrier of the top gripping type which is formed of plastic material and which, by means of a collar, envelops the necks of packaged bottles and supports the bottles on outwardly projecting flanges formed thereon. This carrier does not grip the bottles at points spaced vertically apart and is thus not extremely well adapted for stable vertical stacking of one carrier and its bottles atop another carrier and its bottles.

DISCLOSURE OF INVENTION

According to this invention in one form, a top gripping carrier is provided with collar structure for enveloping the necks of flanged bottles and is characterized by the fact that at least one pair of lift tabs forms a part of each collar the upper ends of which engage the flange of the associated bottle together with a pair of stabilizing tabs which engage the neck of the associated bottle so as to impart a force thereto a component of which is in a lateral direction and a component of which is in a downward direction so as to impart gripping action to the bottle at point spaced apart along the neck thereof.

According to one feature of the invention, alignment pins are formed integrally with the stabilizing tabs and extend downwardly so as partially to envelop the caps of bottles to be packaged and thereby properly to align the carrier above a group of bottles as a preliminary step to engaging and forcing the carrier downwardly into enveloping relation with respect to the necks of the bottles.

According to a feature of the invention, the alignment pins are located in one carrier in such a position that they project into space formed in a carrier therebelow so as to facilitate easy and efficient stacking of the one carrier atop another prior to loading of the carriers, thereby to conserve space during handling and shipment.

The carrier frame is constructed of a planar element and of reinforcing ribs and is provided with finger gripping apertures for easy portability. In addition other apertures are formed adjacent the finger gripping apertures and may serve as convenient receptacles for the fingers of the user.

BEST MODE OF CARRYING OUT THE INVENTION

Figure 1:
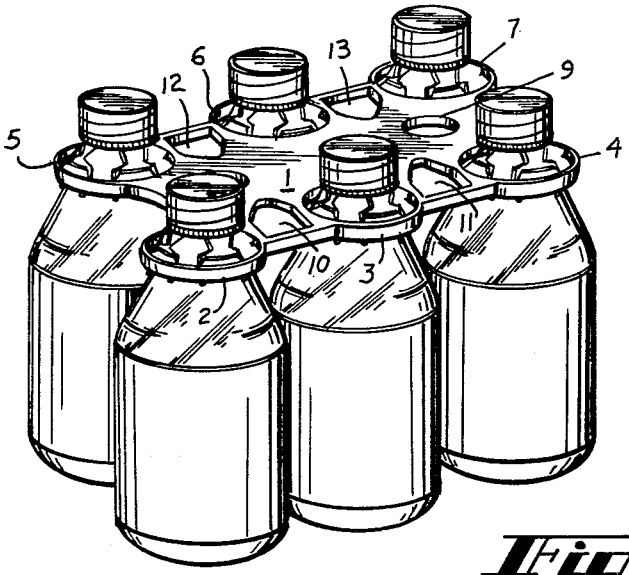
FIG. 1 is a perspective view of a carrier loaded with bottles in accordance with this invention.

With reference to FIG. 1, the numeral 1 generally designates the carrier frame structure while the numerals 2–7 inclusive designate collars formed in and supported by the frame structure 1. A pair of finger gripping apertures 8 and 9 as well as apertures 10–13 inclusive are formed in frame structure 1 and serve as receptacles for the fingers of the user. For example, with the user's thumb inserted into aperture 9 and with the middle finger inserted into aperture 8, the fingers on either side of the middle finger may be inserted into apertures 10 and 12 and thus form a secure and convenient method of gripping the carrier. Likewise if the user's thumb is inserted into aperture 8 and his middle finger inserted into aperture 9 the fingers on either side of the middle finger may be inserted into apertures 11 and 13.

Figure 3:
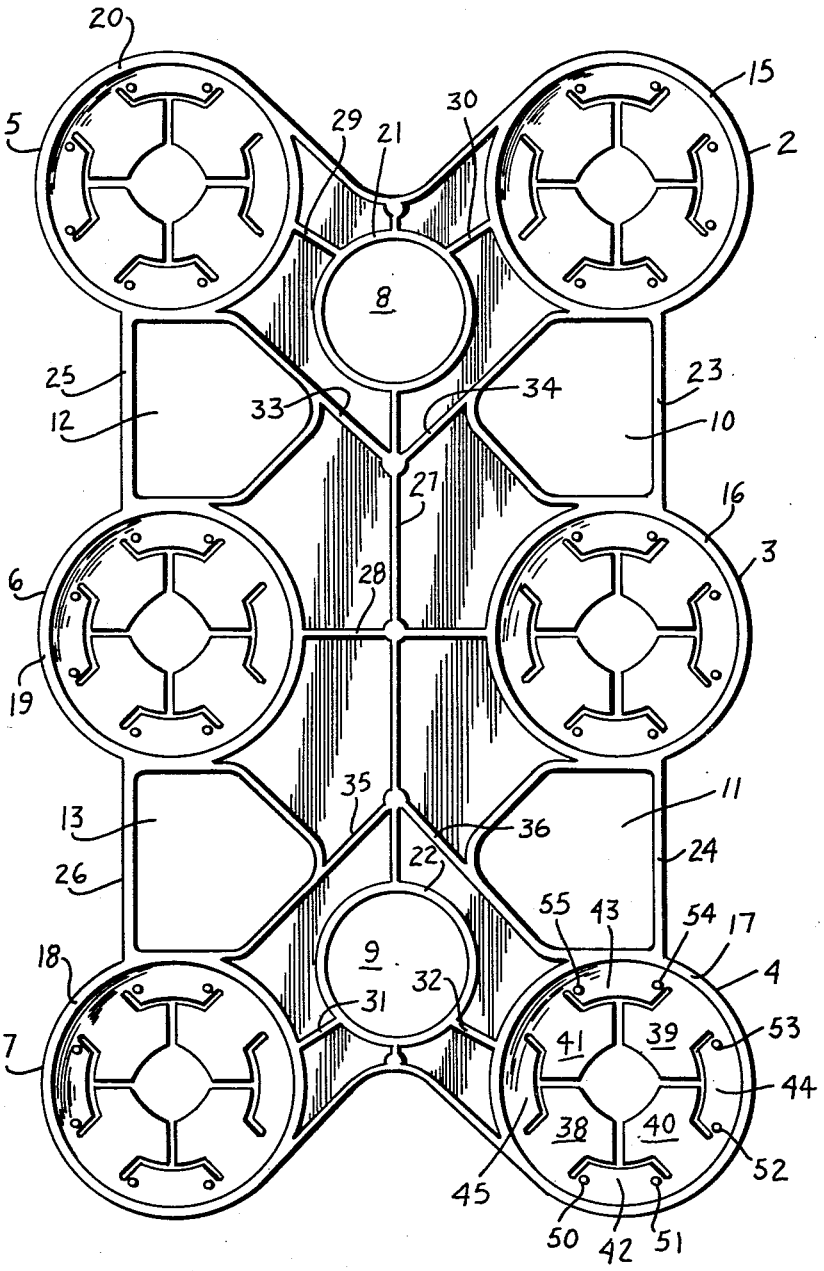
FIG. 3 is a view similar to FIG. 2 but depicts the carrier as viewed from below.

The frame structure 1 comprises a planar element from which reinforcing ribs depend. As is best seen in FIG. 3, collar 2 is surrounded by reinforcing ribs 15 while collars 3–7 are surrounded by reinforcing ribs 16–20 respectively. Apertures 8 and 9 are surrounded by reinforcing ribs 21 and 22 and apertures 10 and 11 are surrounded by reinforcing ribs 23 and 24 while apertures 12 and 13 are surrounded by reinforcing ribs 25 and 26 respectively. Medial longitudinal reinforcing rib 27 is formed in the frame structure 1 as is transverse reinforcing rib 28. Short reinforcing ribs 29–36 are disposed as shown best in FIG. 3.

Figure 4:
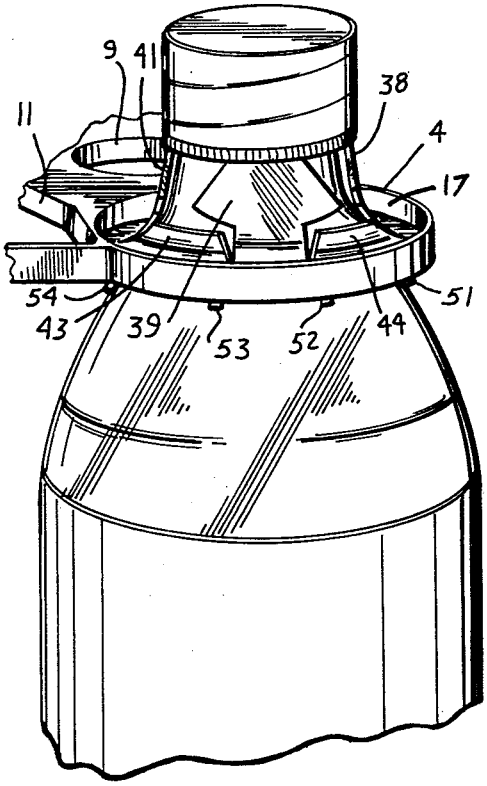
FIG. 4 is an enlarged fragmentary view of a portion of the carrier as shown in FIG. 1.
Figure 5:
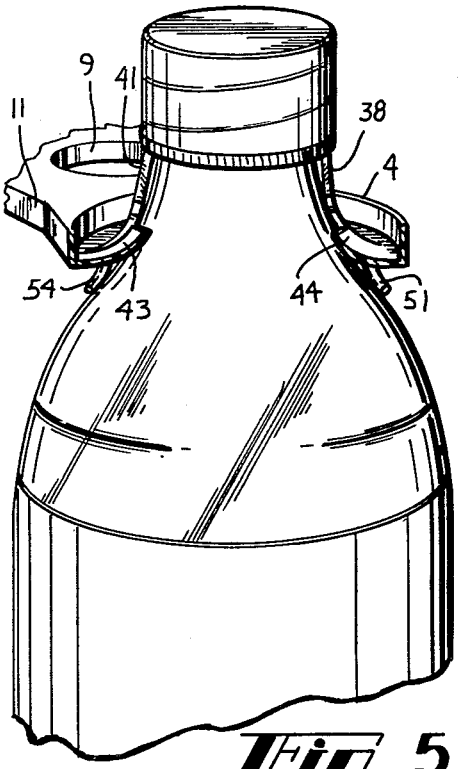
FIG. 5 is an enlarged fragmentary view of the part of the carrier shown in FIG. 4 with a portion thereof broken away.
Figure 2:
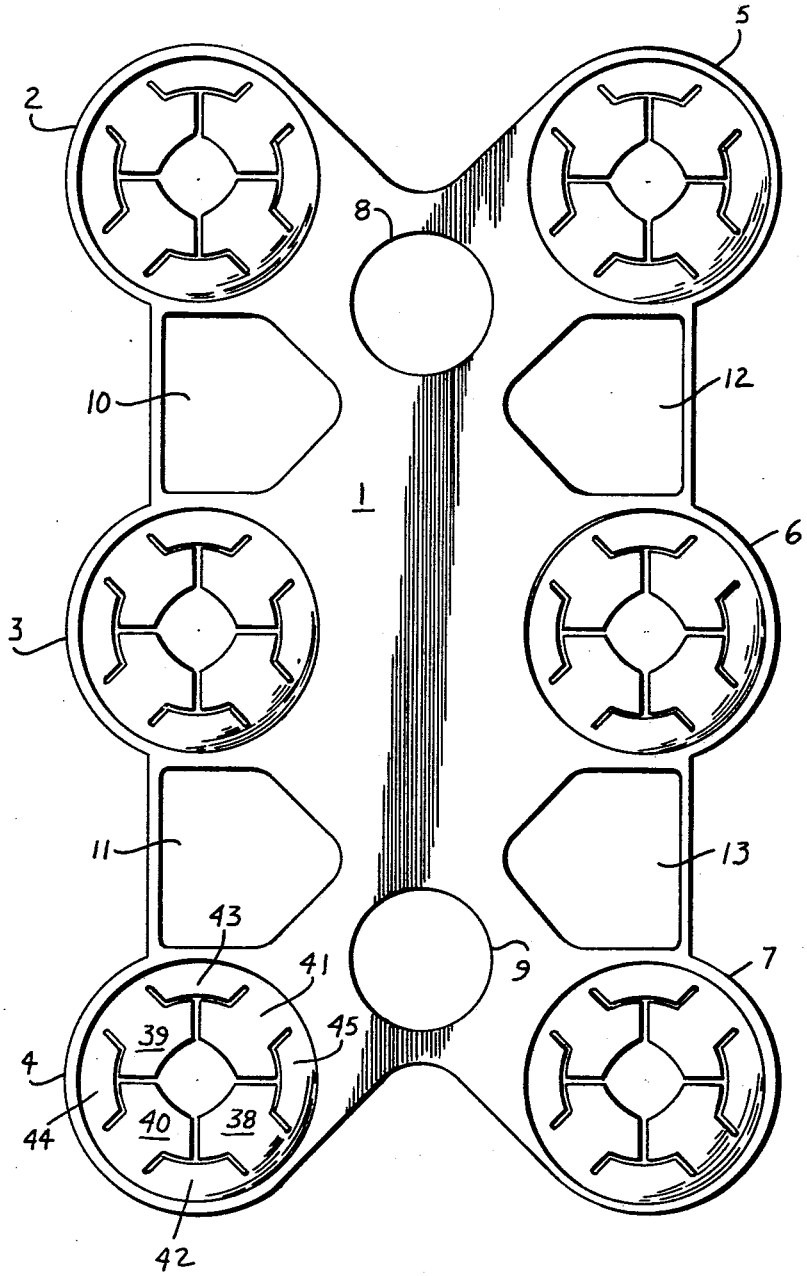
FIG. 2 is a plan view of an inloaded carrier formed according to the invention as seen from above.

All of the collars formed according to this invention are identical in that each collar comprises two pairs of lift tabs and two pairs of stabilizing tabs. Only one collar, such as collar 4, is here described in detail. A pair of lift tabs which are diametrically disposed with respect to each other are identified by the numerals 38 and 39. Similar lift tabs 40 and 41 are also provided in the arrangement shown in the drawings although it will be understood that for some applications of the invention only two lift tabs are required. As is apparent in FIGS. 1 and 4 lift tabs such as 38 and 39 are disposed at a substantial angle to the neck of the associated bottle and their upper edges engage the bottle flange. This bottle flange in some applications of the invention is integrally formed with the bottle neck itself or in other applications of the invention may simply constitute the lower edge of a bottle cap. Clearly the lift tabs impart an upward force to the bottle and since the carrier is formed of semi-rigid material these lift tabs when disposed in enveloping relation relative to the bottle neck exert an inward force due to the inherent spring action of the tabs.

For applying a force to the bottle necks at a level spaced downwardly from the bottle flange, a plurality of stabilizing tabs are provided according to a feature of this invention. One pair of stabilizing tabs is designated by the numerals 42 and 43 while the other pair of stabilizing tabs is designated by the numerals 44 and 45. These stabilizing tabs are much shorter than are the lift tabs but are so positioned and constructed that they impart a force to the bottle neck which has a component in a lateral direction toward the bottle and in a downward direction as a result of this particular construction and cooperation between the lift and stabilizing tabs, the bottle is effectively gripped at two points spaced vertically one above the other. By this means substantial stability is imparted to the loaded carrier so that several loaded carriers may be stacked one on top of the other. This is a distinguishing feature of the invention and results in structure which is much more stable than prior known devices. In addition stabilizing tabs 42–45 are sufficiently flexible to flex slightly when they engage the bottle shoulders to allow lift tabs 38–41 to over travel slightly the lower edge of the associated bottle flange or cap as the carrier is lowered into loaded position. Then a spring action of the flexing of stabilizing tabs 42–45 allows the lift tabs 38–41 to slide upwardly into a snug abutting relationship with the bottle flange or cap.

According to another feature of this invention, the collars 2–7 are of convex configuration as viewed from above, i.e., the midportion of the collars is at a level above the peripheral or base portions of both the lift and stabilizing tabs. With reference, for example, to collar 4 it will be understood that reinforcing rib 17 defines a space adjacent the inner surface thereof and adjacent the base of each lift tab and of each stabilizing tab which is below the level of the upper edge portion of the reinforcing rib 17. Therefore the midportion of each collar is at a different level than the basis of the associated ribs. This fact is significant because alignment pins such as are designated by the numerals 50–55 in FIG. 3 are formed on the lower surfaces of stabilizing tabs 42, 43 and 44 and are allowed to enter and occupy the corresponding spaces of an adjacent carrier when the unloaded carriers are arranged in a stacked condition one atop another. These downwardly projecting alignment pins are simply for the purpose of enveloping the cap of a bottle as the carrier is lowered downwardly through a chute or otherwise to occupy a position atop a group of bottles disposed therebelow. Thus alignment pins 50–55 envelop the caps of the bottles and are of identical construction and arrangement at each of the collars 2–7.

In addition to serving as means for positioning the carrier atop a group of bottles, the alignment pins also serve as resilient cushioning means by which the stabilizing tabs engage the necks of the associated bottles. Thus as is apparent in FIG. 4 the alignment pins are flexed somewhat and since they too are formed of semi-rigid material they aid in imparting a cushioning force downwardly and laterally to the associated bottle neck.

While a carrier formed according to this invention is not limited to a particular material, it has been found that high density polyethylene is a very satisfactory material. An alternative material is polypropylene. The carrier is formed by injection molding, preferably, although some of the features of this invention may be incorporated into carriers formed by other procedures.

INDUSTRIAL APPLICABILITY

This invention is well suited for use in conjunction with the packaging of bottles used as primary packages for consumer products. The invention is very well adapted for use in forming stacked displays of product in supermarkets. Floor space is conserved due to the fact that the carrier is unusally stable and thus lends itself to stacking one atop another into a great many tiers of carriers.

I claim:

1. A bottle carrier of the top gripping type for packaging a plurality of bottles having flanged neck portions and arranged in at least one row, said carrier being formed of semi-rigid plastic material and comprising a frame structure, a plurality of collars integrally formed with said frame structure for respectively enveloping the necks of a plurality of bottles, each collar including a plurality of lift tabs of substantially equal length and distributed about the periphery of the associated bottle neck and in upwardly inclined relation with their upper ends in engagement with the flange of the associated bottle throughout a substantial part of the periphery of the bottle neck, and a plurality of stabilizing tabs distributed about the periphery of the associated bottle neck and of substantially equal length and substantially shorter in length than said lift tabs and arranged to engage the neck of the associated bottle at a level substantially below the level of the upper ends of said lift tabs for imparting a gripping force thereto in a lateral and downward direction against the bottle shoulder and which is distributed about the periphery of the neck of the associated bottle, each of said stabilizing tabs being disposed between a pair of lift tabs.

2. A carrier according to claim 1 wherein said lift tabs and said stabilizing tabs are arranged in pairs and respectively diametrically opposed to each other.

3. A carrier according to claim 1 wherein said lift tabs and said stabilizing tabs are alternately arranged.

4. A carrier according to claim 1 wherein said stabilizing tabs are somewhat flexible.

5. A carrier according to claim 1 wherein at least one alignment pin is formed on the lower surface of some of said stabilizing tabs for initially positioning the carrier atop a group of bottles.

6. A carrier according to claim 5 wherein said alignment pins engage the shoulder of an associated bottle when the carrier is arranged in bottle carrying position.

7. A carrier according to claim 6 wherein said alignment pins are integrally formed with said stabilizing tabs and are flexed into a bent configuration due to engagement with the bottle shoulder so as to make cushioned contact therewith.

* * * * *